United States Patent [19]

Hirabayashi et al.

[11] Patent Number: 5,023,169

[45] **Date of Patent: * Jun. 11, 1991**

[54] LIGHT-SENSITIVE SILVER HALIDE COLOR PHOTOGRAPHIC MATERIAL

[75] Inventors: Shigeto Hirabayashi, Hachioji; Mayumi Tsuruta, Hino; Noboru Mizukura, Kanagawa, all of Japan

[73] Assignee: Konica Corporation, Tokyo, Japan

[ * ] Notice: The portion of the term of this patent subsequent to Feb. 12, 2008 has been disclaimed.

[21] Appl. No.: 449,422

[22] Filed: Dec. 15, 1989

Related U.S. Application Data

[63] Continuation of Ser. No. 333,832, Apr. 5, 1989, abandoned, which is a continuation of Ser. No. 170,397, Mar. 18, 1988, abandoned.

[30] Foreign Application Priority Data

Mar. 20, 1987 [JP] Japan ..... 62-66277

[51] Int. Cl.[5] ..... G03C 7/36; G03C 7/38

[52] U.S. Cl. ..... 430/505; 430/556; 430/557

[58] Field of Search ..... 430/505, 556, 557, 558

[56] References Cited

U.S. PATENT DOCUMENTS

| | | | |
|---|---|---|---|
| 4,286,053 | 8/1981 | Ishikawa et al. | 430/557 |
| 4,356,258 | 10/1982 | Usui et al. | 430/557 |
| 4,404,274 | 9/1983 | Arai et al. | 430/557 |
| 4,443,536 | 4/1984 | Lestina | 430/556 |
| 4,513,082 | 4/1985 | Furutachi et al. | 430/556 |
| 4,607,002 | 8/1986 | Nakayama et al. | 430/557 |
| 4,622,287 | 11/1986 | Umemoto et al. | 430/505 |
| 4,748,100 | 5/1988 | Umemoto et al. | 430/557 |

FOREIGN PATENT DOCUMENTS

| | | |
|---|---|---|
| 0183444 | 6/1986 | European Pat. Off. . |
| 0207794 | 1/1987 | European Pat. Off. . |
| 2442464 | 6/1980 | France . |
| 2066811 | 7/1981 | United Kingdom . |

*Primary Examiner*—Richard L. Schilling

*Attorney, Agent, or Firm*—Finnegan, Henderson, Farabow, Garrett and Dunner

[57] ABSTRACT

A silver halide light-sensitive color photographic material which is capable of forming a dye image of improved spectral absorption characteristic, resulting in the improved color reproducibility as well as in the image preservability and which has a high maximum density is disclosed. The material comprises a green-sensitive silver halide emulsion layer containing a magenta coupler having the following Formula [M-I], Formula [M-I]

wherein Z, X and R is as defined in the description; and a blue-sensitive silver halide emulsion layer contains a yellow coupler having the following Formula [Y-I];

Formula [Y-I]

wherein $R_{21}$, $R_{22}$, $R_{23}$, n, $R_{24}$, J and $X_1$ are respectively as defined in the description.

8 Claims, No Drawings

LIGHT-SENSITIVE SILVER HALIDE COLOR PHOTOGRAPHIC MATERIAL

This application is a continuation of application Ser. No. 333,832 filed Apr. 5, 1989, now abandoned, which is a continuation of application Ser. No. 170,397, filed Mar. 18, 1988, now abandoned.

FIELD OF THE INVENTION

The present invention relates to a light-sensitive silver halide color photographic material capable of forming a dye image of which the dyes formed are so satisfactory in the spectral absorption characteristic as to be excellent in the color reproducibility as well as in the image preservability and which has a high maximum density.

BACKGROUND OF THE INVENTION

In light-sensitive silver halide photographic materials for use in making images for direct appreciation. particularly color photographic paper and the like, as the dye-forming couplers therefor, generally, yellow couplers, magenta couplers and cyan couplers are used in combination. As the magenta coupler out of these couplers, pyrazoloazole-type magenta couplers have been developed in recent years.

The pyrazoloazole-type magenta coupler, unlike those 5-pyrazolone-type magenta couplers, which have conventionally been used, is characteristic of being advantageous in the color reproducibility because the dye formed therefrom has no secondary absorption in the proximity of 430 nm.

On the other hand, those yellow couplers which are used generally along with the above-mentioned magenta coupler have disadvantages that the absorption maximum wavelength of the dye formed therefrom is generally positioned on the longer wave side than the absorption wavelength desirable for the color reproducibility, and the absorption of the dye in the longer wavelength region exceeding 500 nm does not sharply diminish to nil.

Accordingly, in such a silver halide light-sensitive photographic material, there has been a problem that, even if a pyrazoloazole-type coupler is used as a magenta coupler, any adequate color reproducibility for colors such as yellow, green and yellowish green cannot be obtained due to the above-mentioned disadvantages of the yellow coupler. For this reason, there has been a demand for the realization of a yellow coupler wherein the absorption maximum wavelength of the dye formed therefrom be positioned on the further shorter wavelength side and the absorption of the dye in the longer wavelength side exceeding 500 nm sharply diminish.

As has been mentioned above, it is the present situation that any light-sensitive silver halide photographic materials excellent in the overall color reproducibility for all colors are still not found.

SUMMARY OF THE INVENTION

It is an object of the present invention to provide a light-sensitive silver halide photographic material capable of forming a dye image of which the dyes formed are so improved on the spectral absorption characteristic thereof as to be excellent in the color reproducibility for all colors as well as in the dye image preservability and color formability.

The above object of this invention is accomplished by a silver halide light-sensitive photographic material comprising a support and, provided thereon, at least one blue-sensitive silver halide emulsion layer, at least one green-sensitive silver halide emulsion layer and at least one red-sensitive silver halide emulsion layer, in which said green-sensitive silver halide emulsion layer contains a magenta coupler having the following Formula [M-1], and said blue-sensitive silver halide emulsion layer contains a yellow coupler having the following Formula [Y-I]:

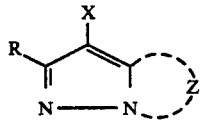

Formula [M-I]

wherein Z is a group of non-metal atoms necessary to form a nitrogen-containing heterocyclic ring, provided that the ring formed by the Z may have a substituent: X is a group capable of being split off upon the reaction with the oxidation product of a color developing agent; and R is a hydrogen atom or a substituent.

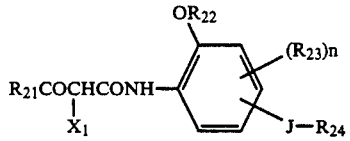

Formula [Y-I]

wherein $R_{21}$ is an alkyl group or a cycloalkyl group: $R_{22}$ is an alkyl group, a cycloalkyl group, an acyl group or an aryl group; $R_{23}$ is a group substitutable to the benzen ring; n is an integer of 0 or 1; $R_{24}$ is an organic group containing one linkage group having a carbonyl or sulfonyl unit; J is a

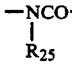

group or a

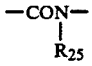

group (wherein $R_{25}$ is a hydrogen atom, an alkyl group, an aryl group or a heterocyclic group): and $X_1$ is a group capable of being split off upon the reaction with the oxidation product of a color developing agent.

DETAILED DESCRIPTION OF THE INVENTION

In a magenta coupler represented by the foregoing Formula [M-I]:

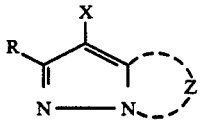

the Z represents a group of non-metal atoms necessary to form a nitrogen-containing heterocyclic ring, provided that the ring formed by the Z may have a substituent.

The X is a hydrogen atom or a group capable of being split off upon the reaction with the oxidation product of a color developing agent.

The R is a hydrogen atom or a substituent.

The substituent represented by the R, although not particularly restricted, is typified by various groups including alkyl, aryl, anilino, acylamino, sulfonamido, alkylthio, arylthio, alkenyl, cycloalkyl and the like groups, and also including halogen atoms and cycloalkenyl, alkinyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclic thio groups, and in addition, spirocompound residues, cross-linked hydrocarbon compound residues, and the like.

The alkyl group represented by the R is preferred to be one having from 1 to 32 carbon atoms, which may be in the either straight-chain or branched-chain form.

The aryl group represented by the R is preferably a phenyl group.

The acylamino group represented by the R is an alkylcarbonylamino group, arylcarbonylamino group or the like.

The sulfonamido group represented by the R is an alkylsulfonylamino group, arylsulfonylamino group, or the like.

The alkyl and aryl constituents of the alkylthio and arylthio groups represented by the R may be the same as the alkyl and aryl groups, respectively, as defined in the above R.

The alkenyl group represented by the R is one having preferably from 2 to 32 carbon atoms, and the cycloalkyl group is one having preferably from 3 to 12 carbon atoms, and particularly preferably from 5 to 7 carbon atoms. The alkenyl group may be in the either straight-chain or branched-chain form.

The cycloalkenyl group represented by the R is one having from 3 to 12 carbon atoms, and particularly preferably from 5 to 7 carbon atoms.

The sulfonyl group represented by the R is an alkylsulfonyl group, arylsulfonyl group, or the like.

The sulfinyl group is an alkylsulfinyl group, arylsulfinyl group or the like.

The phosphonyl group is an alkylphosphonyl group, alkoxyphosphonyl group, aryloxyphosphonyl group, arylphosphonyl group or the like.

The acyl group is an alkylcarbonyl group, arylcarbonyl group or the like.

The carbamoyl group is an alkylcarbamoyl group, arylcarbamoyl group or the like.

The sulfamoyl group is an alkylsulfamoyl group, arylsulfamoyl group or the like.

The acyloxy group is an alkylcarbonyloxy group, arylcarbonyloxy group or the like.

The carbamoyloxy group is an alkylcarbamoyloxy group, arylcarbamoyloxy group or the like.

The ureido group is an alkylureido group, arylureido group or the like.

The sulfamoylamino group is an alkylsulfamoylamino group, arylsulfamoylamino group or the like.

The heterocyclic group is preferably a 5- to 7-member heterocyclic group, and is, for example, a 2-furyl group. 2-thienyl group, 2-pyrimidinyl group, 2-benzothiazolyl group or the like.

The heterocyclic oxy group is preferably one having a 5- to 7-member heterocyclic ring, such as, for example, 3,4,5,6-tetrahydropyranyl-2-oxy group, 1-phenyltetrazolo-5-oxy group or the like.

The heterocyclic thio group is preferably a 5- to 7-member heterocyclic thio group, and is, for example, a 2-pyridylthio group, 2-benzothiazolylthio group, 2,4-diphenoxy-1,3,5-triazolo-6-thio group or the like.

The siloxy group is a trimethylsiloxy group, triethylsiloxy group, dimethylbutylsiloxy group or the like.

The imido group is a succinic acid imido group, 3-heptadecyl-succinic acid imido group, phthalimido group, glutarimido group or the like.

The spiro compound residue is a spiro[3.3]heptan-1-yl or the like.

The cross-linked hydrocarbon compound residue is a bicyclo-[2.2.1]heptan-1-yl, tricyclo[3.3.1.1$^{3,7}$]decan-1-yl, 7,7-dimethyl-bicyclo[2.2.1]heptan-1-yl, or the like.

The group represented by the X, which is capable of being split off upon the reaction with the oxidation product of a color developing agent, is, for example, a halogen atom (such as chlorine, bromine, fluorine) or an alkoxy group, aryloxy group, heterocyclic oxy group, acyloxy group, sulfonyloxy group, alkoxycarbonyloxy group, aryloxycarbonyl group, alkyloxalyloxy group, alkoxyoxalyloxy group, alkylthio group, arylthio group, heterocyclic thio group, alkyloxythiocarbonylthio group, acylamino group, sulfonamide group, nitrogen-containing heterocyclic group whose ring is formed by the bonding of an N atom, alkyloxycarbonylamino group, aryloxycarbonylamino group, carboxyl group or a group having the formula:

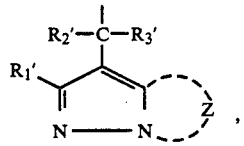

wherein $R_1'$ is as defined in the foregoing R; Z' is as defined in the foregoing Z; $R_2'$ and $R_3'$ each is a hydrogen atom, an aryl, alkyl or heterocyclic group). or the like, but is preferably a halogen atom, and more preferably a chlorine atom.

The nitrogen-containing heterocyclic ring formed by the Z or Z' is a pyrazole ring, imidazole ring, triazole ring or etrazole ring, and the substituent which any of these rings ay have includes those as defined in the foregoing R.

The magenta couplers having Formula [M-I], to be more concrete, include those having the following Formulas [M-II] through [M-VII]:

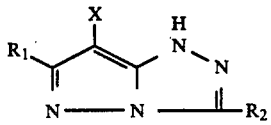

[M-II]

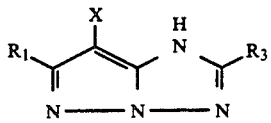

[M-III]

-continued

[M-IV]

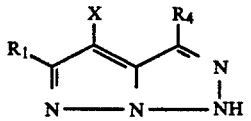

[M-V]

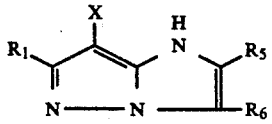

[M-VI]

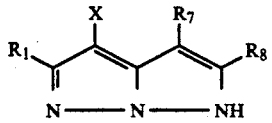

[M-VII]

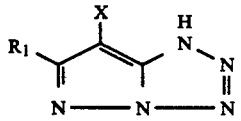

In the above Formulas [M-II] through [M-VII], $R_1$ through $R_8$ and X are the same as the foregoing R and X, respectively.

The preferred among those having Formula [M-I] are ones having the following Formula [M-VIII]:

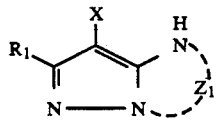

wherein $R_1$, X and $Z_1$ are as defined in the R, X and Z, respectively, of the foregoing Formula [M-I].

The particularly preferred among the magenta couplers having the foregoing Formulas [M-II] through [M-VII] are those magenta couplers having the Formula [M-II].

The most preferred as the substituents R and $R_1$ to the foregoing heterocyclic ring are those having the following Formula [M-IX]:

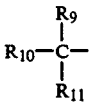

wherein $R_9$, $R_{10}$ and $R_{11}$ are as defined in the foregoing R.

Two out of the $R_9$, $R_{10}$ and $R_{11}$, e.g., $R_9$ and $R_{10}$, may combine with each other to form a saturated or unsaturated ring (such as a cycloalkane, cycloalkene or heterocyclic ring), and further $R_{11}$ may additionally combine with them to form a cross-linked hydrocarbon residue.

The preferred cases of Formula [M-IX]are (i) where at least two out of $R_9$ through $R_{11}$ are alkyl groups and (ii) where one out of $R_9$ through $R_{11}$, e g., $R_{11}$, is a hydrogen atom and the others, $R_9$ and $R_{10}$, combine with each other to form a cycloalkyl group together with the carbon atom at the base.

The more preferred instance in the case (i) is where two out of $R_9$ through $R_{11}$ are alkyl groups and the other one is a hydrogen atom or an alkyl group.

As the substituent which may be owned by a ring formed with the Z of Formula [M-I] or by a ring formed with the $Z_1$ of Formula [M-VIII] and as the $R_2$ through $R_8$ of Formulas [M-II] through [M-VI], those having the following Formula [M-X] are preferred:

Formula [M-X]

$$-R^1-SO_2-R^2$$

wherein $R^1$ is an alkylene group: and $R^2$ is an alkyl group, a cycloalkyl group or an aryl group.

The alkylene group represented by the $R^1$ is a straightchain or branched-chain alkylene group, the straight-chain portion of which has preferably 2 or more carbon atoms, and more preferably 3 to 6 carbon atoms.

The cycloalkyl group represented by the $R^2$ is preferred to be a 5- or 6-member cycloalkyl group.

The following are typical examples of the compound of this invention:

1

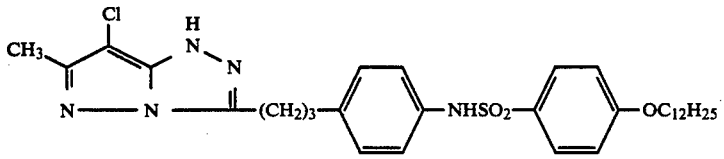

2

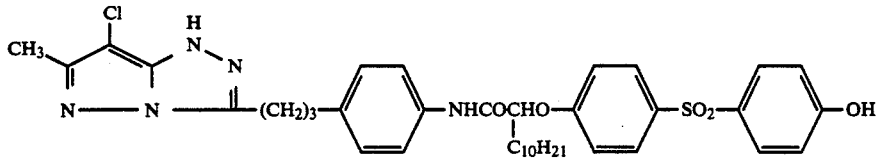

3

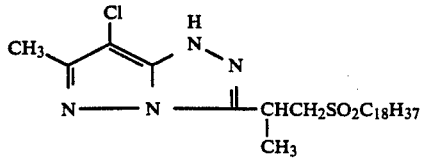

-continued
4
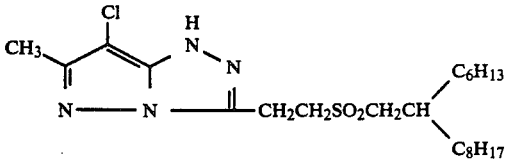
5
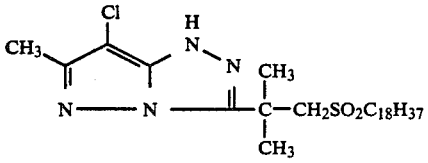
6
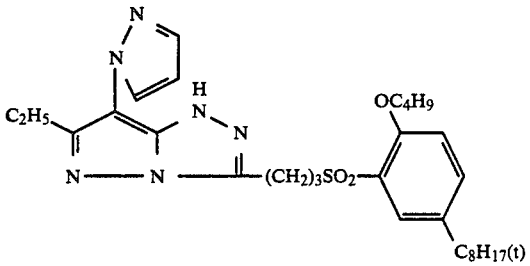
7
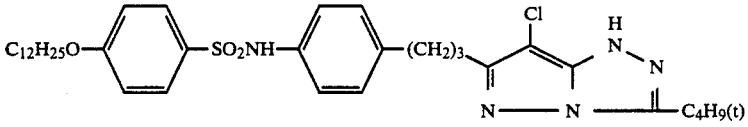
8
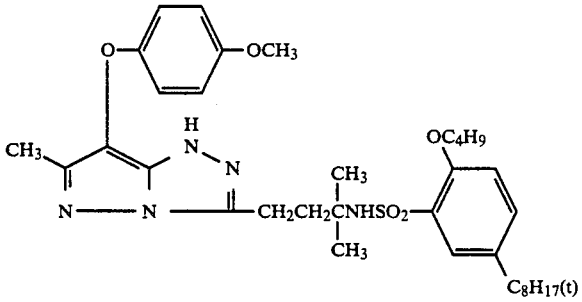
9
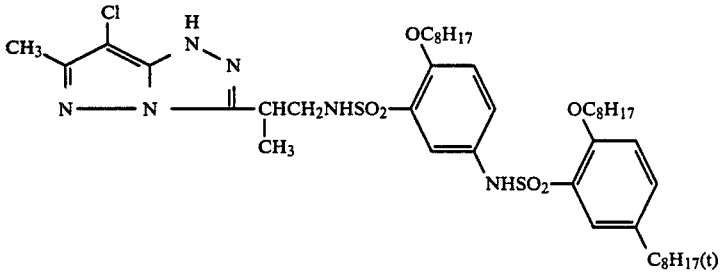
10
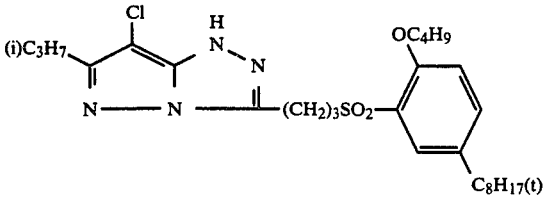

-continued
11
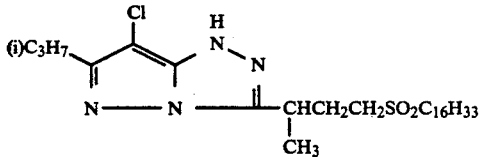
12
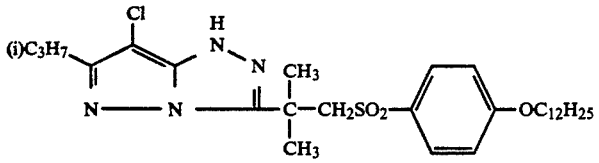
13
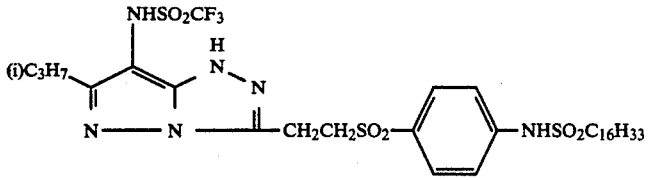
14
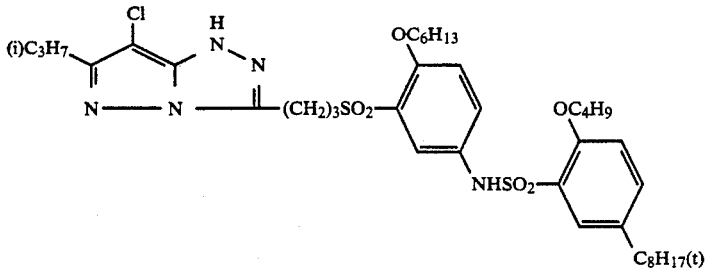
15
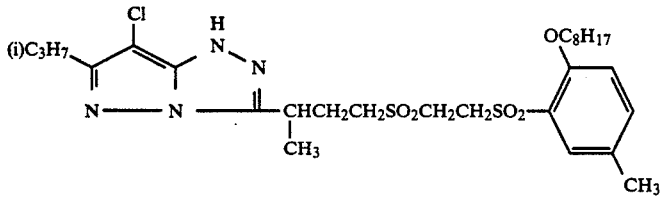
16
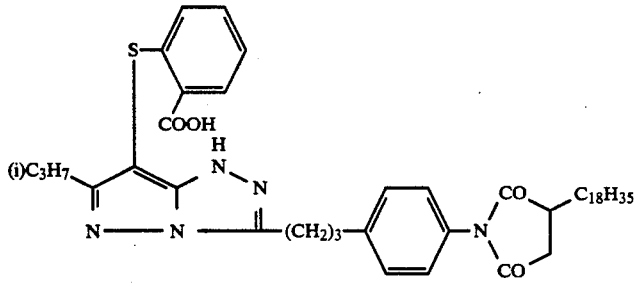
17
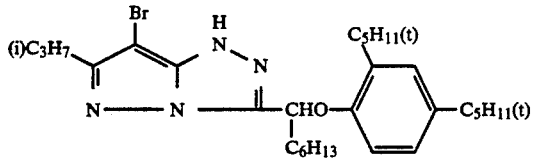
18
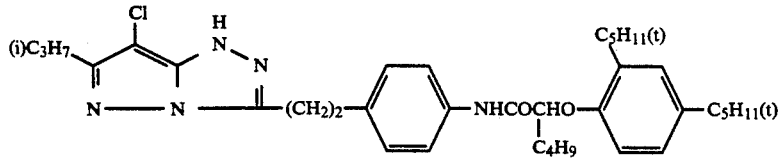

-continued
19
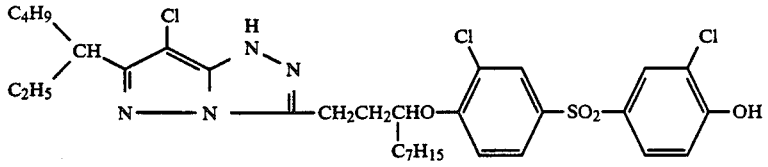
20
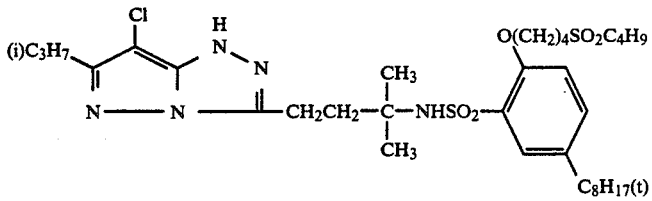
21
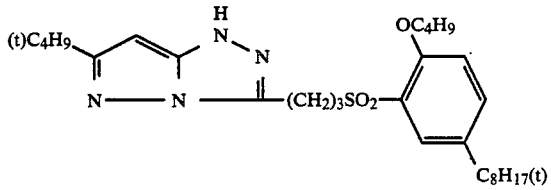
22
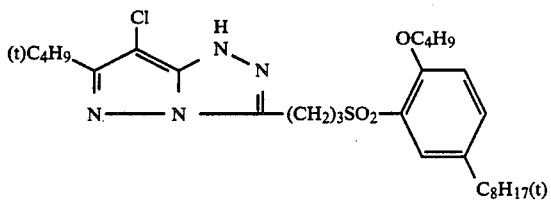
23
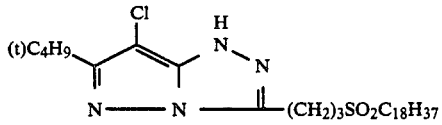
24
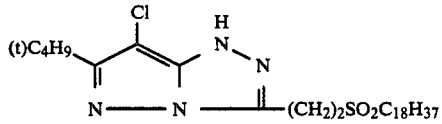
25
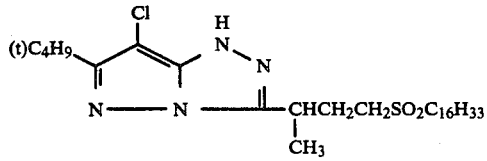
26
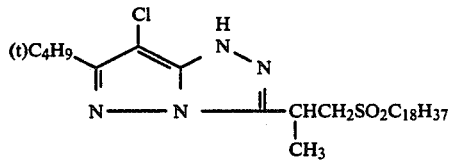
27
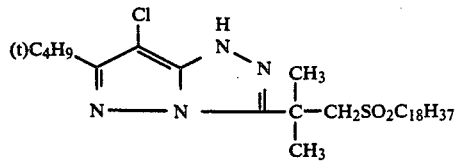

-continued
28
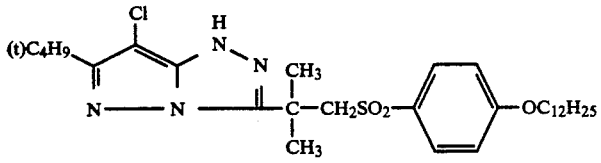
29
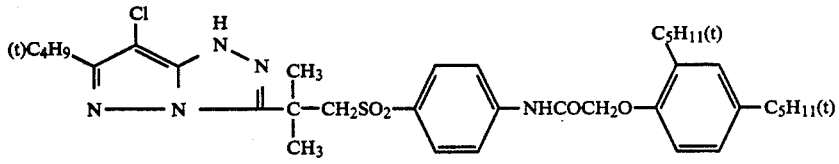
30
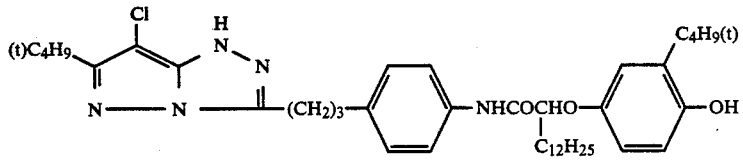
31
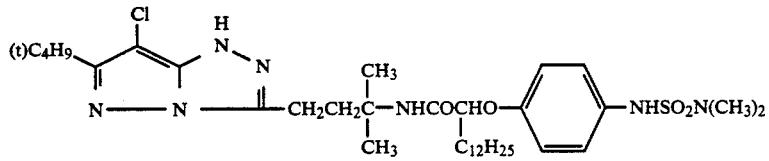
32
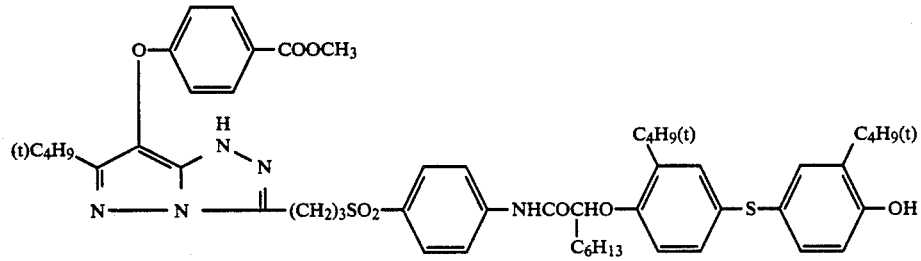
33
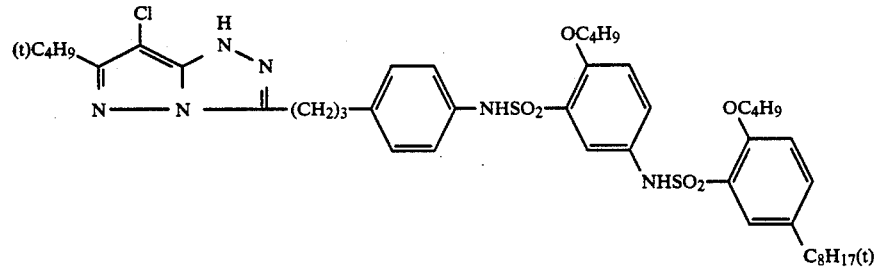
34
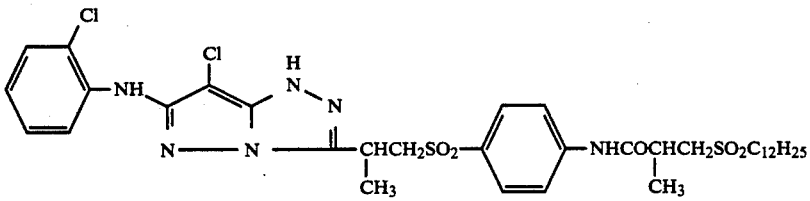
35
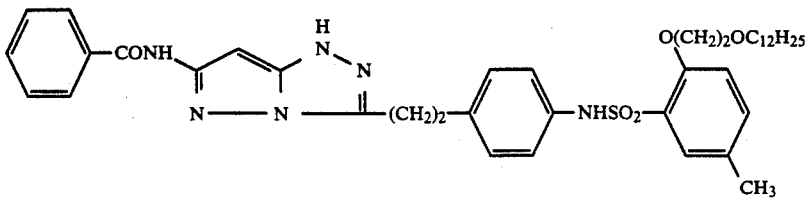

-continued
36
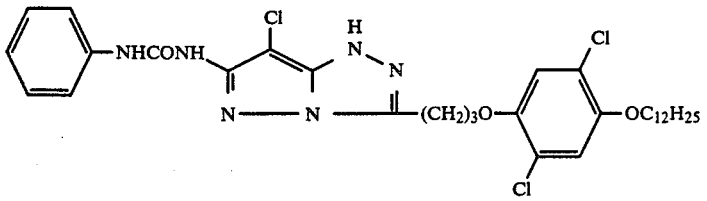
37
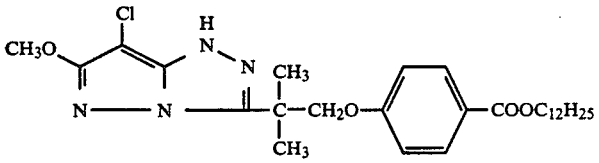
38
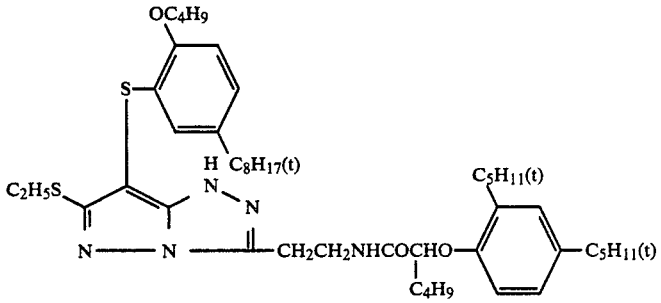
39
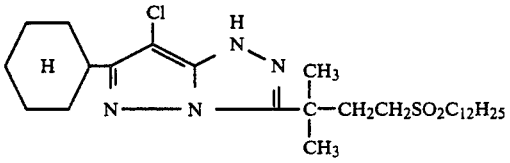
40
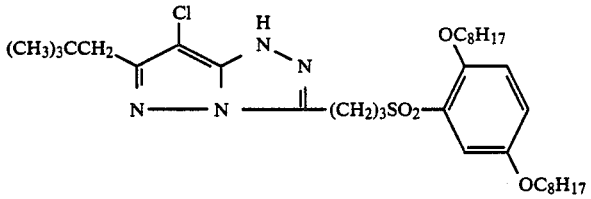
41
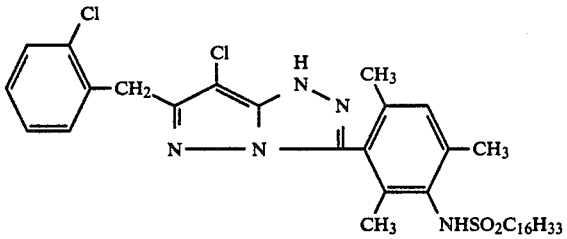
42
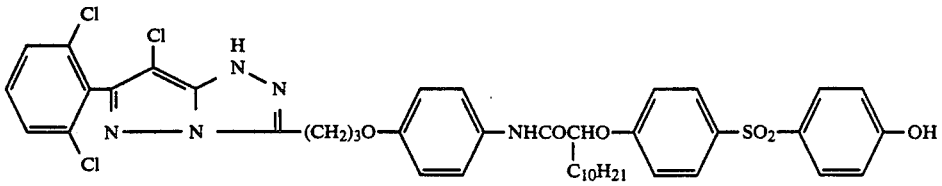

-continued
43
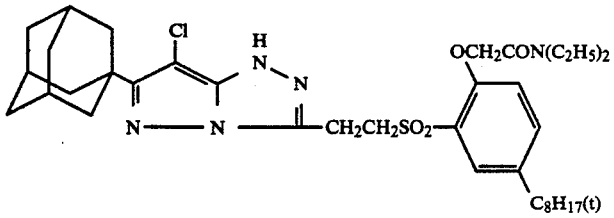
44
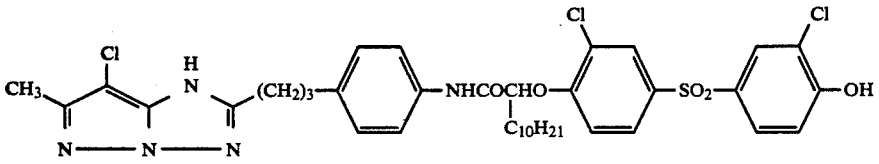
45
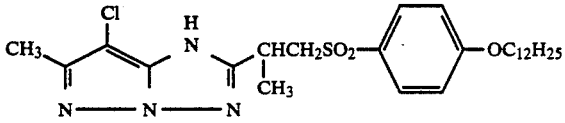
46
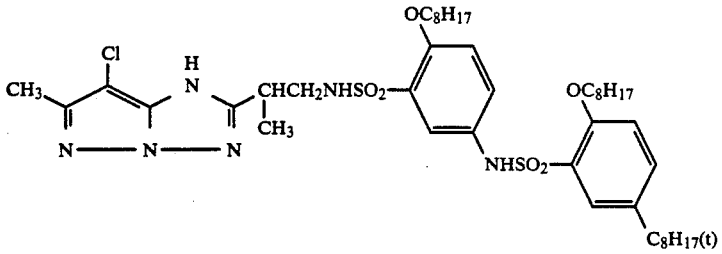
47
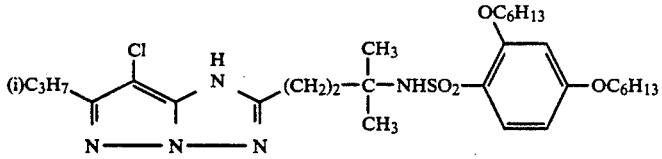
48
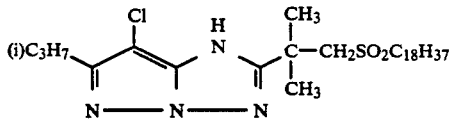
49
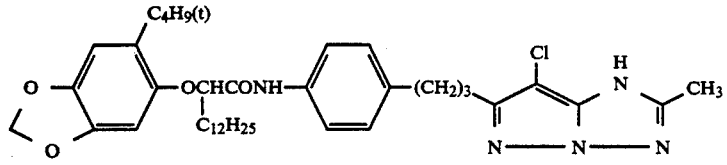
50
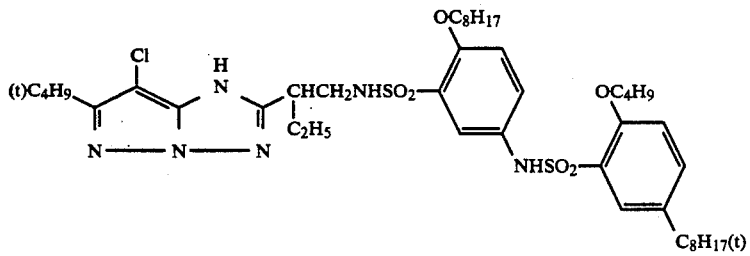

-continued
51
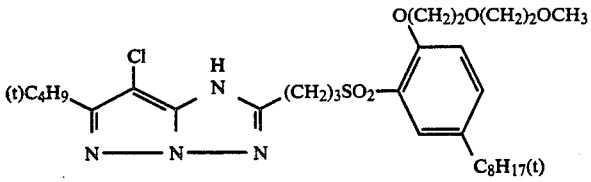
52
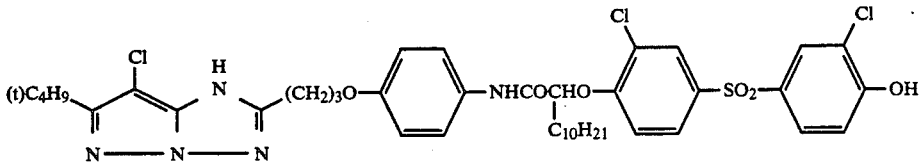
53
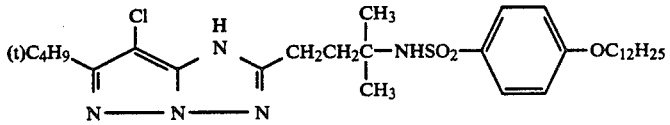
54
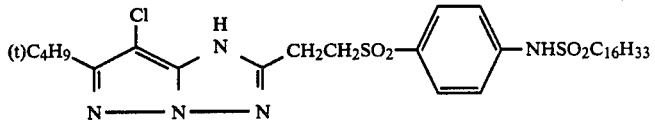
55
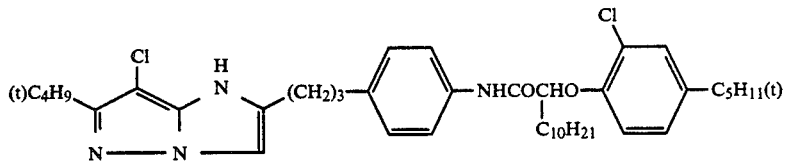
56
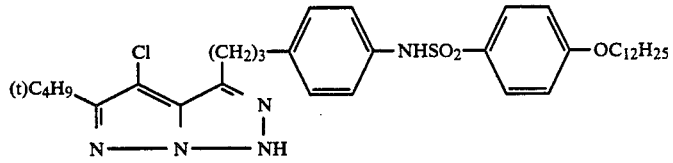
57
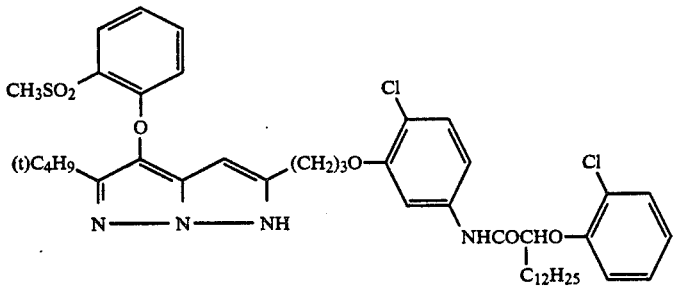
58
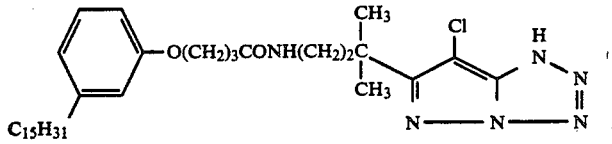
59
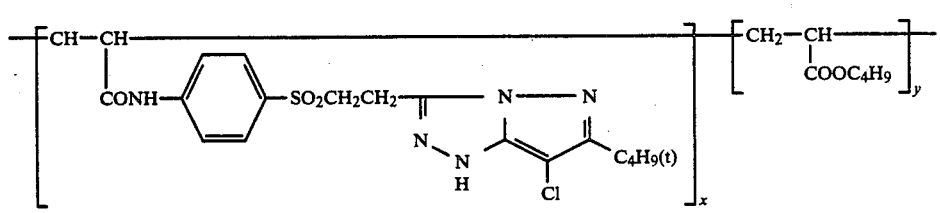
x:y = 50:50

-continued

60

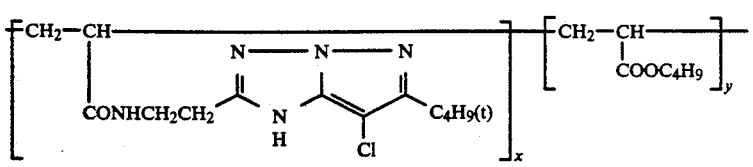

x:y = 50:50

61

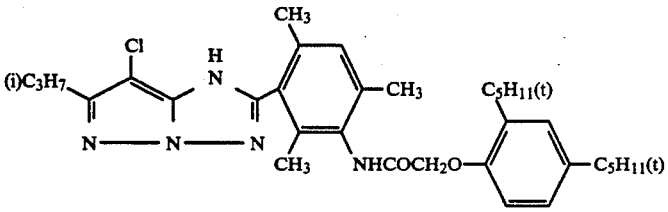

62

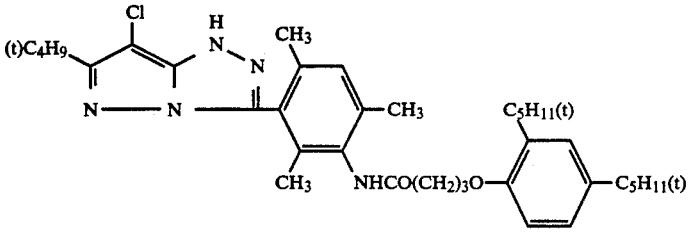

63

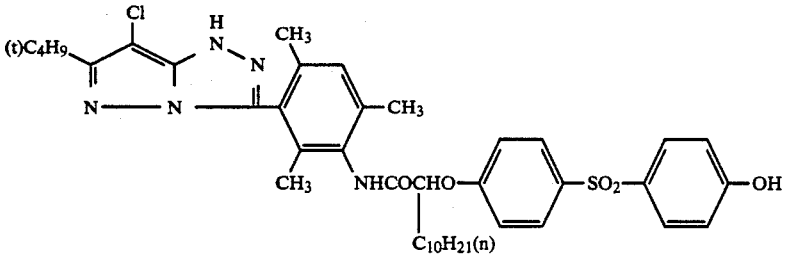

64

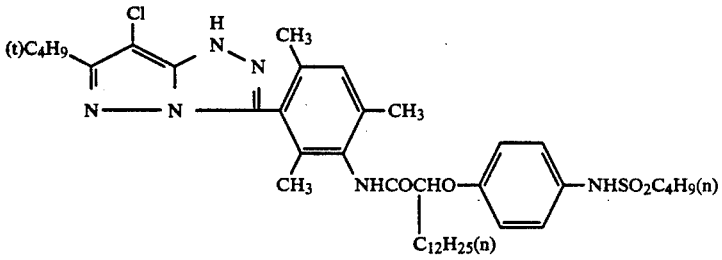

Aside from these exemplified typical examples of the compound of this invention, other additional examples of the compound of this invention include the exemplified compounds Nos. 1 through 4, 8 through 17, 19 through 24, 26 through 43, 44 through 59, 61 through 104, 106 through 121, 123 through 162 and 164 through 223 out of those compounds described in pages 66 through 122 of Japanese Patent application No. 9791/1986.

Any of these magenta couplers having the foregoing Formula [M-I] (hereinafter referred to as the magenta coupler of this invention) may be easily synthesized by those skilled in the art by making reference to Journal of the Chemical Society, Perkin I (1977), 2047-2052; U.S. Pat. No. 3,725,067; Japanese Patent Publication Open to Public Inspection (hereinafter referred to as Japanese Patent O.P.I. Publication) Nos. 99437/1984, 42045/1983, 162458/1984, 171956/1984, 33552/1985, 43659/1985, 172982/1985 and 190779/1985.

The magenta coupler of this invention may be used in the amount range of generally from $1\times10^{-3}$ mole to 1 mole per mole of silver halide, and preferably from $1\times10^{-2}$ mole to $8\times10^{-1}$ mole.

The magenta coupler of this invention may be used alone or in combination of two or more kinds thereof, and may also be used in combination with any different other magenta couplers.

Subsequently, those yellow couplers having the foregoing Formula [Y-I] will be explained below:

In Formula [Y-I], the alkyl group represented by the $R_{21}$ is, for example, an methyl group, ethyl group, isopropyl group, t-butyl group, or the like. These alkyl groups represented by the $R_{21}$ also include those each having a substituent. The substituent is, for example, a halogen atom or an aryl group, alkoxy group, aryloxy group, alkylsulfonyl group, acylamino group, alkoxy group or hydroxy group.

The cycloalkyl group represented by the $R_{21}$ is, e.g., a cyclopropyl group, cyclohexyl group, adamantyl group, or the like.

The preferred one as the $R_{22}$ is a branched-chain alkyl group.

In Formula [Y-I], the alkyl and cycloalkyl groups represented by the $R_{22}$, include similar groups to those as defined in the $R_{21}$, and the aryl group is, for example, a phenyl group. These alkyl, cycloalkyl and aryl groups represented by the $R_{22}$ also include those each having a substituent similar to the one as defined in the $R_{22}$. And the acyl group is, e.g., an acetyl group, propionyl group, butyryl group, hexanoyl group, benzoyl group, or the like.

The $R_{22}$ is preferably an alkyl or aryl group, and more preferably an alkyl group.

In Formula [Y-I], the benzene ring-substitutable group represented by the $R_{23}$ is, e.g., a halogen atom (such as chlorine atom) or an alkyl group (such as ethyl, i-propyl. t-butyl), alkoxy group (such as methoxy), aryloxy group (such as phenyloxy), acyloxy group (such as methylcarbonyloxy,. benzoyloxy), acylamino group (such as acetamido, phenylcarbonylamino), carbamoyl group (such as N-methylcarbamoyl, N-phenylcarbamoyl), alkylsulfonamido (such as ethylsulfonylamino), arylsulfonamido group (such as phenylsulfonamino), sulfamoyl group (such as N-propylsulfamoyl, N-phenylsulfamoyl), imido group (such as succinic acid imido, glutarimido) or the like. And the n is 0 or 1.

In Formula [Y-I], the $R_{24}$ represents an organic group containing one linkage group having a carbonyl or sulfonyl unit.

The carbonyl unit-having group is, e.g., an ester group, amido group, carbamoyl group, ureido group, urethano group or the like, and the sulfonyl unit-having group is, e.g., a sulfo group, sulfonamido group, sulfamoyl group, aminosulfonamido group, or the like.

The J is a

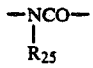

group or

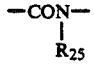

group, wherein $R_{25}$ is a hydrogen atom or an alkyl, aryl or heterocyclic group.

The alkyl group represented by the $R_{25}$ is, e.g., a methyl group, ethyl group, isopropyl group, t-butyl group, dodecyl group or the like, and the aryl group represented by the $R^{25}$ is a phenyl or naphthyl group.

These alkyl, aryl and heterocyclic groups represented by the $R_{25}$ include those each having a substituent.

In Formula [Y-I], the $X_1$ is a group capable of being split off upon the reaction with the oxidation product of a color developing agent, and includes those groups having the following Formula [Y-II] or Formula [Y-III]:

$$-OR_{26} \qquad \text{[Y-II]}$$

wherein $R_{26}$ is an aryl group or heterocyclic group, both being allowed to have a substituent.

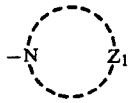

[Y-III]

wherein $Z_1$ is a group of non-metal atoms necessary to form in cooperation with a nitrogen atom a 5-or 6-member ring. Examples of the atom or atomic group necessary to form such the group of nonmetallic atoms include methylene, methine, substituted methine, >O=O, —NH—, —N=, —O—, —S—, —$SO_2$ and the like.

Those two-equivalent yellow couplers represented by Formula [Y-I] may be in the form of a bis-type compound by combining with each other through the $R_{21}$, $R_{23}$ or $R_{24}$.

The preferred ones as the two-equivalent yellow coupler of this invention are those having the following Formula [Y-IV]:

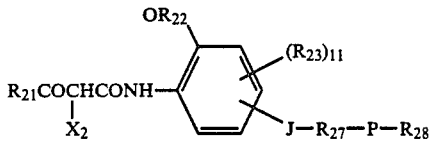

[Y-IV]

wherein $R_{21}$, $R_{22}$, $R_{23}$ and J are as defined in the $R_{21}$, $R_{22}$, $R_{23}$ and J, respectively, of Formula [Y-I]; n is an integer of 0 or 1; $R_{27}$ is an alkylene group. arylene group, alkylene-arylene group, arylene-alkylene group or -A-$V_1$-B- group (wherein A and B each is an alkylene, arylene. alkylene-arylene or arylene-alkylene group. and V' is a bivalent linkage group such as —O—, —S—, etc.); $R_{28}$ is an alkyl group, cycloalkyl group. aryl group or heterocyclic group: P is a linkage group having a carbonyl or sulfonyl unit; and $X_2$ is the same as the foregoing $X_1$.

In the above Formula [Y-IV]. the P is a linkage group having a carbonyl or sulfonyl unit, and more preferably represents the following groups [Y-V]:

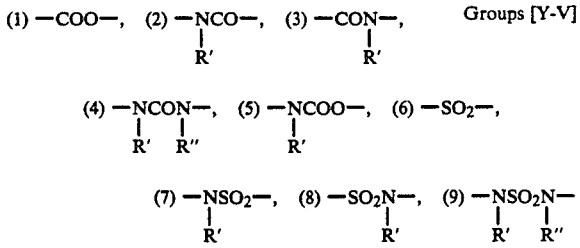

Groups [Y-V]

wherein R' and R'' each is a hydrogen atom or an alkyl group, aryl group or heterocyclic group, provided that the R' and R'' may be either the same or different.

Those groups represented by the R' or R'' include similar groups to those as defined in the foregoing $R_{25}$, and also include those each having a substituent similar to the one as defined in the $R_{25}$. The R' and R'' each is preferably a hydrogen atom.

In Formula [Y-IV], the $X_2$ is a group capable of being split off upon the coupling reaction, and more preferably represents those groups having the following Formulas [Y-VI]through [Y-XII]:

[Y-VI]

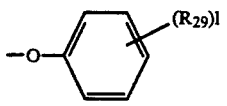

wherein $R_{29}$ is a carboxyl group, ester group, acyl group, alkylsulfonyl group, arylsulfonyl group, hydroxy group or a substituent similar to any of those groups represented by the $R_{23}$: and 1 is an integer of from 1 to 5, provided that when 1 is 2 or more, the $R_{29}$s may be the same or different.

[Y-VII]

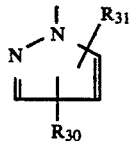

[Y-VIII]

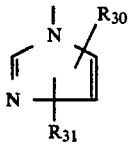

[Y-IX]

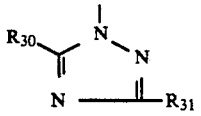

wherein $R_{30}$ and $R_{31}$ each is a hydrogen atom, a halogen atom or an alkyl group, alkoxy group, aryl group, heterocylic group, carboxylic ester group, amino group, acylamino group, alkylsulfonyl group, arylsulfonyl group, alkylsulfinyl group, arylsulfinyl group, alkylsulfonamide group, arylsulfonamide group or carboxylic acid group, and these groups represented by both $R_{30}$ and $R_{31}$ may be either the same or different. Also, the $R_{30}$ and $R_{31}$ may form together a ring.

[Y-X]

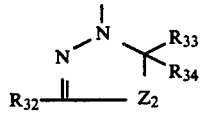

[Y-XI]

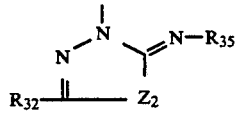

wherein $Z_2$ and $Z_3$ each is a hetero atom: and $R_{32}$, $R_{33}$ and $R_{34}$ each represents similar groups to those as defined in the above $R_{30}$ and $R_{32}$; $R_{35}$ is an alkyl group, aryl group, alkylcarbonyl group, arylcarbonyl group, alkylsulfonyl group or arylsulfonyl group.

[Y-XII]

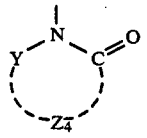

wherein Y is a hetero atom or or a group of hetero atoms (such as —NH—, —N=, —O—, —S—, etc.) or a sulfonyl group,carbonyl group or carbon atom represented by

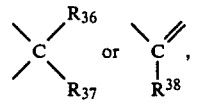

and $Z^4$ is a group of non-metal atoms necessary to form in cooperation with the —Y—N—CO— a 5- or 6-member ring.

The $R_{36}$, $R_{37}$ and $R_{38}$ each represents similar groups to those respresented by the foregoing $R_{30}$ or $R_{31}$. Also, the $R_{36}$, $R_{37}$ and $R_{38}$ may form a ring in cooperation with part of the $Z_4$.

The two-equivalent yellow coupler having the foregoing Formula [Y-IV] may be a bis-type compound formed by combining with each other through the $R_{22}$, $R_{23}$ or a ballasting group.

The following are typical examples of the yellow coupler having Formula [Y-I] usable in this invention, but the invention is not limited by the examples.

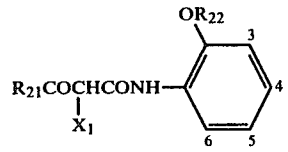
| NO. | $R_{21}$ | $R_{22}$ | $X_1$ | 3 | 4 | 5 | 6 |
|---|---|---|---|---|---|---|---|
| 1 | (t)$C_4H_9$— | —$CH_3$ | 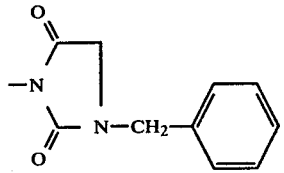 | —H | —H | —$NHCOCH_2CH(C_{18}H_{37})COOCH_3$ | —H |
| 2 | (t)$C_4H_9$— | —$CH_3$ | 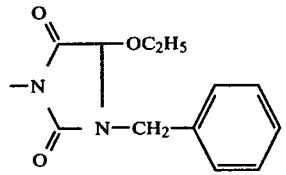 | —H | —H | 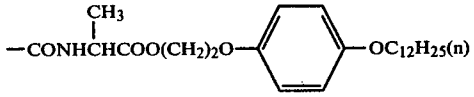 | —H |
| 3 | (t)$C_4H_9$— | —$CH_3$ | 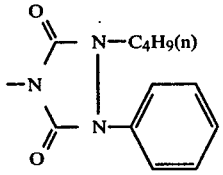 | —H | —H | —$NHCOCH(CH_3)CH_2SO_2C_{12}H_{25}(n)$ | —H |
| 4 | (t)$C_4H_9$— | —$CH_3$ | 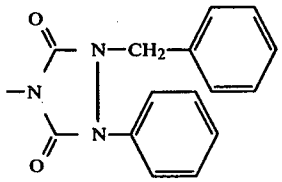 | —H | —H | 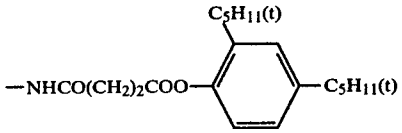 | —H |

-continued
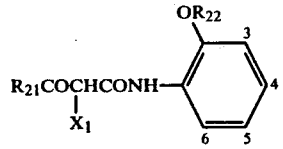
| NO. | $R_{21}$ | $R_{22}$ | $X_1$ | 3 | 4 | 5 | 6 |
|---|---|---|---|---|---|---|---|
| 5 | (t)$C_4H_9$— | —$CH_3$ | 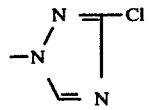 | —H | —H | 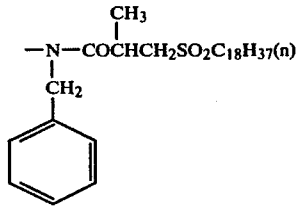 | —H |
| 6 | (t)$C_4H_9$— | —$CH_3$ | 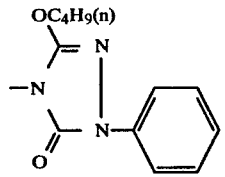 | —H | —H | —NHCO$(CH_2)_2$CON$C_{12}H_{25}$(n) \| $C_2H_5$ | —H |
| 7 | (t)$C_4H_9$— | —$C_3H_7$(iso) | 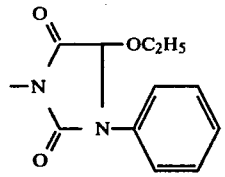 | —H | —H | —CONH$(CH_2)_3$CONH— 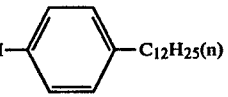 —$C_{12}H_{25}$(n) | —H |
| 8 | (t)$C_4H_9$— | —$CH_3$ | 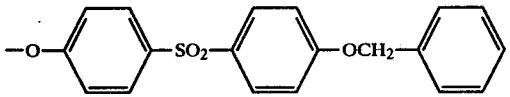 | —H | —H | —CONH— 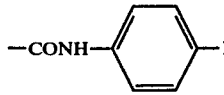 —NHCO$C_{12}H_{25}$(n) | —H |
| 9 | (t)$C_4H_9$— | —$C_{12}H_{25}$(n) | 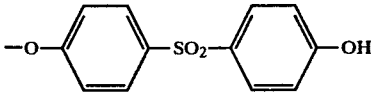 | —H | —H | —CONHCH$CH_2SO_2C_2H_5$ \| $CH_3$ | —H |

-continued
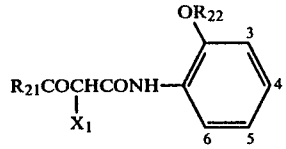
| NO. | $R_{21}$ | $R_{22}$ | $X_1$ | 3 | 4 | 5 | 6 |
|---|---|---|---|---|---|---|---|
| 10 | (t)$C_4H_9$— | —$C_{18}H_{37}$(n) | 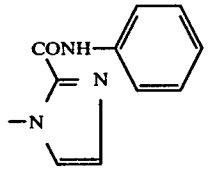 | —H | —H | —NHCO(CH$_3$)CH$_2$SO$_2$C$_4$H$_9$(n) | —H |
| 11 | (t)$C_4H_9$— | —$CH_3$ | 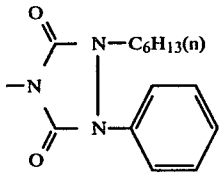 | —H | —H | —NHCO(CH$_3$)CHNHCO—C$_6$H$_4$—OC$_{12}$H$_{25}$(n) | —H |
| 12 | (t)$C_4H_9$— | —$C_4H_9$ | 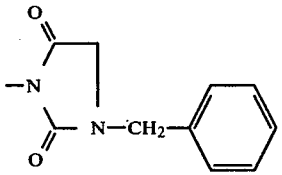 | —H | —H | —NHCO(C$_{12}$H$_{25}$)CHO—C$_6$H$_4$—SO$_2$NHC$_4$H$_9$(n) | —H |
| 13 | (t)$C_4H_9$— | —$CH_3$ | 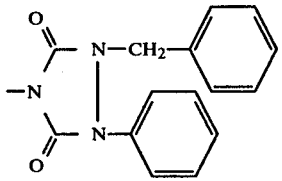 | —H | —H | —CONH(CH$_2$)$_2$NHSO$_2$C$_{12}$H$_{25}$(n) | —H |
| 14 | (t)$C_4H_9$— | —$CH_3$ | 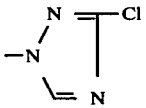 | —H | —H | —CONH(CH$_3$)CH$_2$SO$_2$CH$_2$CH(C$_6$H$_{13}$(n))C$_8$H$_{17}$(n) | —H |

-continued
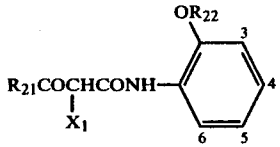
| NO. | $R_{21}$ | $R_{22}$ | $X_1$ | 3 | 4 | 5 | 6 |
|---|---|---|---|---|---|---|---|
| 15 | (t)$C_4H_9$— | —$CH_3$ | 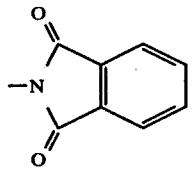 | —H | —H | —NHCO(C$_{12}$H$_{25}$(n))CH$_2$NHCOOC$_2$H$_5$ | —H |
| 16 | (t)$C_4H_9$— | —$CH_3$ | 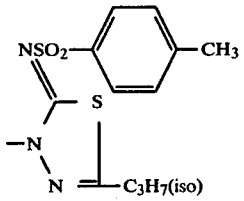 | —H | —H | —NHCO(CH$_3$)CH(CH$_2$)$_2$NHCO—C$_6$H$_4$—OC$_{12}$H$_{25}$(n) | —H |
| 17 | $C_2H_5OCH_2C(CH_3)_2$— | —$CH_3$ | 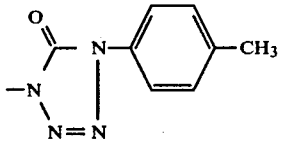 | —H | —H | —NHCO(CH$_2$)$_{10}$COOC$_2$H$_5$ | —H |
| 18 | (t)$C_4H_9$— | —$CH_3$ | 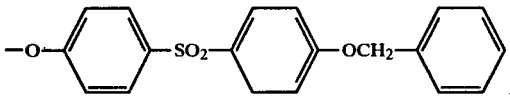 | —H | —H | —CONH—C$_6$H$_4$—SO$_2$NHC$_{12}$H$_{25}$(n) | —H |
| 19 | (t)$C_4H_9$— | —$CH_3$ | 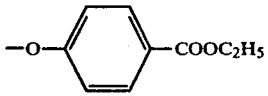 | —H | —H | —NHCO—C$_6$H$_4$—NHSO$_2$CH$_2$—C$_6$H$_3$(C$_5$H$_{11}$(t))—C$_5$H$_{11}$(t) | —H |

-continued
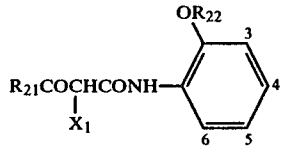
| NO. | $R_{21}$ | $R_{22}$ | $X_1$ | 3 | 4 | 5 | 6 |
|---|---|---|---|---|---|---|---|
| 20 | (t)$C_4H_9$— | —$C_{12}H_{25}$(n) | 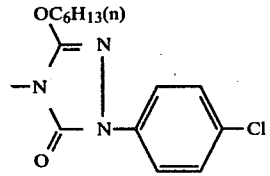 | —H | —H | —NHCO$(CH_2)_2SO_2NHCH_2CHC_4H_9$(n) \| $C_2H_5$ | —H |
| 21 | (t)$C_4H_9$— | —$C_2H_5$ | 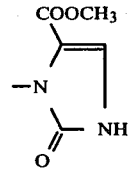 | —H | —Cl | 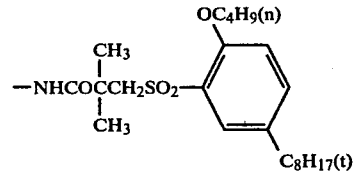 | —H |
| 22 | 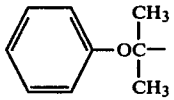 | —$C_4H_9$(n) | 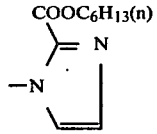 | —H | —H | 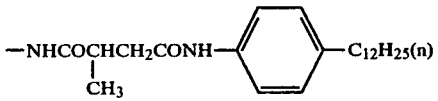 | —H |
| 23 | (t)$C_5H_{11}$ | —$C_2H_5$ | 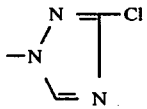 | —H | —H | 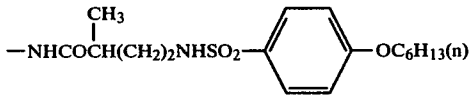 | —H |
| 24 | (t)$C_4H_9$— | —$CH_3$ | 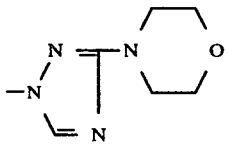 | —H | —H | 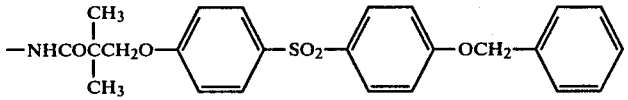 | —H |

-continued
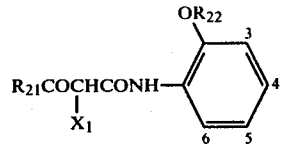
| NO. | $R_{21}$ | $R_{22}$ | $X_1$ | 3 | 4 | 5 | 6 |
|---|---|---|---|---|---|---|---|
| 25 | $(t)C_4H_9$— | —$C_{16}H_{37}(n)$ | 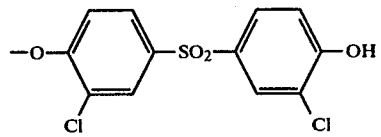 | —H | —H | —$NHCO(CH_2)_2NHSO_2N$—$CH_3$ 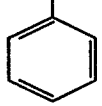 | —H |
| 26 | $(t)C_4H_9$— | —$CH_3$ | 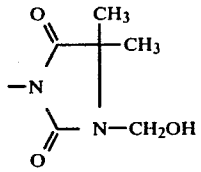 | —H | —H | —$CONH(CH_2)_4NHCO$— 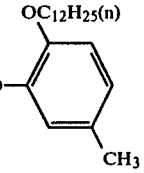 | —H |
| 27 | $(t)C_4H_9$— | —$CH_3$ | 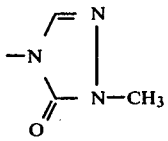 | —H | —H | —$CONHCHCH_2SO_2NHC_{12}H_{25}(n)$ \| $C_6H_{13}(n)$ | —H |
| 28 | $(t)C_4H_9$— | —$CH_3$ | 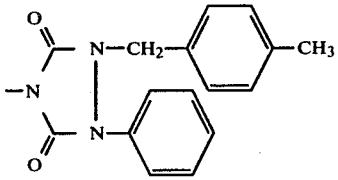 | —H | —H | —$CONH(CH_2)_3NHCOOC_{12}H_{25}(n)$ | —H |
| 29 | 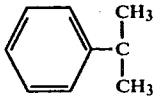 | —$C_{12}H_{25}(n)$ | 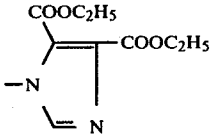 | —H | —H | —$NHCO(CH_2)_3NHCONHCH_2CHC_4H_9(n)$ \| $C_2H_5$ | —H |

-continued
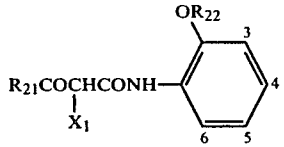
| NO. | $R_{21}$ | $R_{22}$ | $X_1$ | 3 | 4 | 5 | 6 |
|---|---|---|---|---|---|---|---|
| 30 | (t)$C_5H_{11}$— | —$CH_3$ | 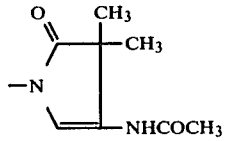 | —H | —H | 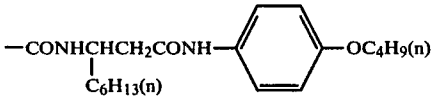 | —H |
| 31 | (t)$C_4H_9$— | —$CH_3$ | 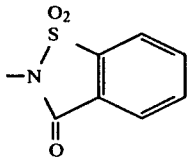 | —H | —H | 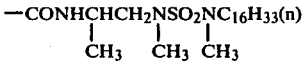 | —H |
| 32 | (t)$C_4H_9$— | —$CH_3$ | 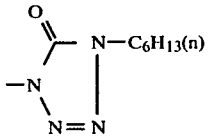 | —H | —H | 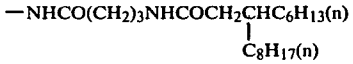 | —H |
| 33 | (t)$C_4H_9$— | —$CH_3$ | 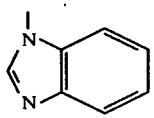 | —H | —Cl | 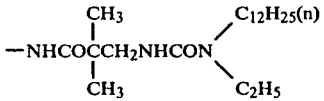 | —H |
| 34 | (t)$C_4H_9$— | 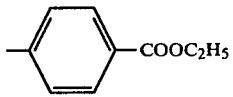 | 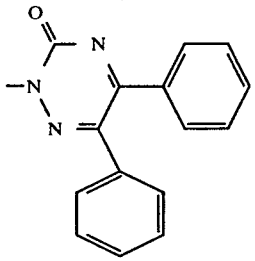 | —H | —H | 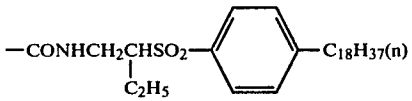 | —H |

-continued
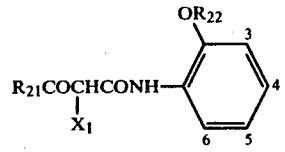
| NO. | $R_{21}$ | $R_{22}$ | $X_1$ | 3 | 4 | 5 | 6 |
|---|---|---|---|---|---|---|---|
| 35 | (t)$C_4H_9$— | —$C_4H_9$(n) | 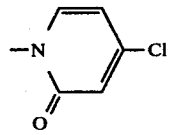 | —H | —NHCO(C$H_{16}H_{33}$(n))SO$_2$NHC$_{12}$H$_{25}$(n) | —Cl | —H |
| 36 | (t)$C_4H_9$— | —$CH_3$ | 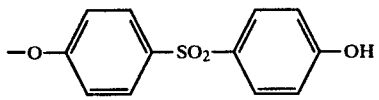 | —H | —Cl | —NHCO(CH$_2$)$_2$NHCO—C$_{12}$H$_{25}$(n) | —H |
| 37 | (t)$C_4H_9$— | 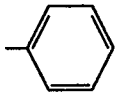 | 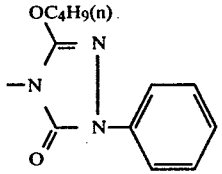 | —H | —H | —CONHC(CH$_2$)$_2$CONH—OC$_{12}$H$_{25}$(n) | —H |
| 38 | (t)$C_5H_{11}$— | —C(=O)$CH_3$ | 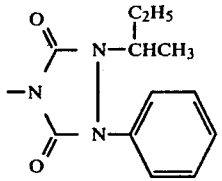 | —H | —$OCH_3$ | 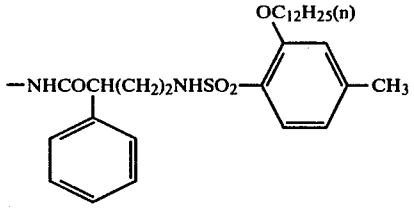 | —H |
| 39 | (t)$C_4H_9$— | —C(=O)$C_2H_5$ | 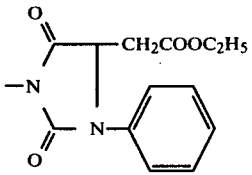 | —H | —H | —NHCOC(CH$_3$)$_2$CH$_2$NHCOOC$_8$H$_{17}$(n) | —H |

-continued
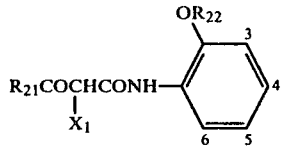
| NO. | $R_{21}$ | $R_{22}$ | $X_1$ | 3 | 4 | 5 | 6 |
|---|---|---|---|---|---|---|---|
| 40 | $(t)C_4H_9$— | —$CH_3$ | 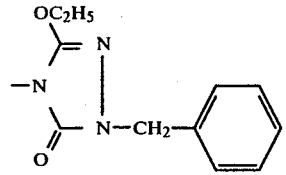 | —H | —H | 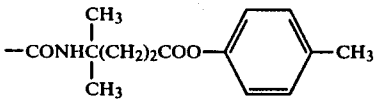 | —H |
| 41 | $(t)C_4H_9$— | —$CH_3$ | 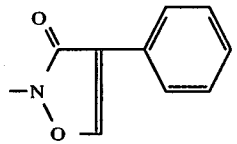 | —H | —$CONH(CH_2)_4NHSO_2CH(CH_3)C_4H_9(n)$ | —$OCH_3$ | —H |
| 42 | $(t)C_4H_9$— | —$CH_3$ | 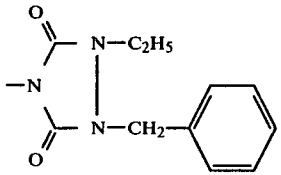 | —H | —H | 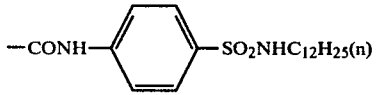 | —H |
| 43 | $(t)C_4H_9$— | —$CH_3$ | 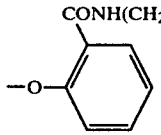 | —H | —H | 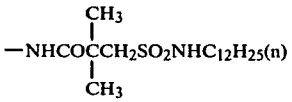 | —H |
| 44 | 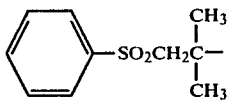 | —$C_2H_5$ | 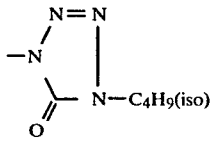 | —H | —H | 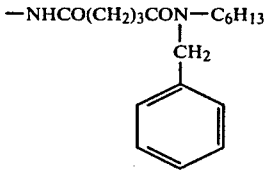 | —H |

-continued
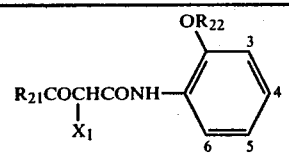
| NO. | $R_{21}$ | $R_{22}$ | $X_1$ | 3 | 4 | 5 | 6 |
|---|---|---|---|---|---|---|---|
| 45 | (t)$C_4H_9$— | 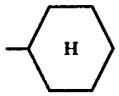 | 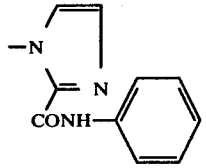 | —H | —H | 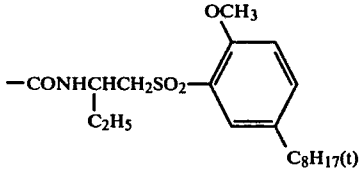 | —H |
| 46 | 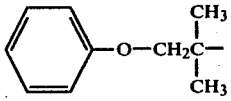 | —$CH_3$ | 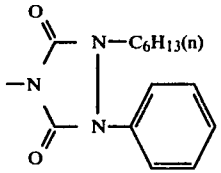 | —H | —H | —$CONHCHCOOC_{12}H_{25}(n)$ \| $C_2H_5$ | —H |
| 47 | (iso)$C_3H_7$— | —$C_4H_9(n)$ | 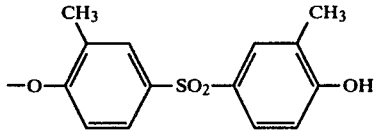 | —H | —H | 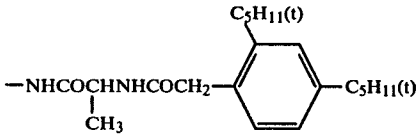 | —H |
| 48 | 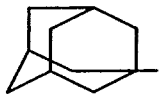 | —$CH_3$ | 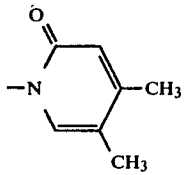 | —H | —H | —$NHCO(CH_2)_{10}COOC_2H_5$ | —H |
| 49 | 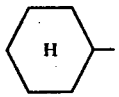 | —$CH_3$ | 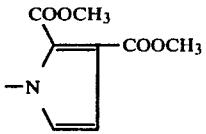 | —H | —H | 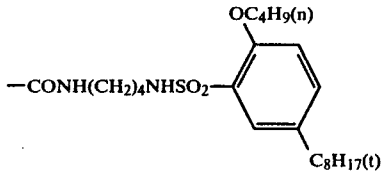 | —H |

-continued
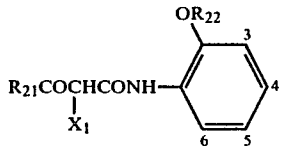
| NO. | $R_{21}$ | $R_{22}$ | $X_1$ | 3 | 4 | 5 | 6 |
|---|---|---|---|---|---|---|---|
| 50 | (t)$C_4H_9$— | —$CH_3$ | 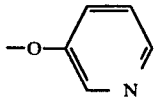 | —H | —H | 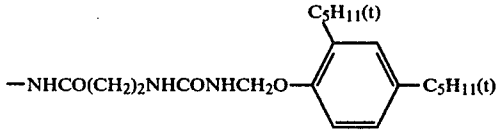 | —H |

The yellow coupler of this invention may be synthesized in accordance with conventionally known methods, and particularly can be synthesized according to those methods as described in pages 27 through 33 of the publication of Japanese Patent application No.269216/1986.

The yellow coupler of this invention may be used alone or in combination of two or more kinds thereof, and may also be used in combination with different other yellow couplers.

In the light-sensitive silver halide photographic material of this invention, the yellow coupler of this invention is added in an amount of preferably from 10 to 300 g per mole of silver halide, but the amount may, if necessary, be changed arbitrarily.

The incorporation of the magenta coupler and yellow coupler of this invention into the light-sensitive silver halide photographic material of this invention may be performed according to any of various methods such as the solid dispersing method, latex dispersing method, oil-in-water-type emulsifiedly dispersing method and the like. For example, in the case of the oil-in-water-type emulsifiedly dispersing method, a hydrophobic additive such as a magenta coupler or yellow coupler is dissolved into a high-boiling solvent having a boiling point of more than about 150° C. such as tricresyl phosphate, dibutyl phthalate or the like, if necessary, along with a low-boiling solvent such as ethyl acetate, butyl propionate or the like and/or an water-soluble organic solvent, and the solution is emulsifiedly dispersed, using a surface active agent, into a hydrophilic binder such as an aqueous gelatin solution, and the dispersed product is then added to an objective hydrophilic colloid layer.

The light-sensitive silver halide photographic material of this invention is applicable to, e.g., color negative and positive films, color photographic paper, and the like, and above all, this invention can exhibit its effect significantly particularly when applied to color photographic paper for use in direct appreciation.

The light-sensitive silver halide photographic material of this invention, including color photographic paper, in order to effect the color reproduction according to the subtractive color process, has a multilayer construction of green-sensitive, blue-sensitive and red-sensitive silver halide emulsion layers containing the magenta and yellow couplers of this invention and a known cyan coupler, respectively, as photographic couplers, and non-light-sensitive layers, coated in an arbitrary number of layers in arbitrary order on the support thereof, but the number of layers and the coating order may be discretionally altered according to priority characteristics or purposes for which the light-sensitive material is used.

Those yellow couplers usable in combination with the yellow coupler of this invention include, for example, benzoylacetanilide-type and pivaloylacetanilide-type compounds, while those magenta couplers usable in combination with the magenta coupler of this invention include pyrazolone-type, pyrazolobenzimidazole-type and open-chain acylacetonitrile-type couplers.

Those cyan couplers usable in the light-sensitive photographic material of this invention include phenol-type and naphthol-type compounds, and concrete examples thereof are described in U.S. Pat. Nos. 2,369,929, 2,434,272, 2,474,493, 2,521,908, 2,895,826, 3,034,892, 3,311,476, 3,458,315, 3,476,563, 3,583,971, 3,591,383, 3,767,411 and 4,004,929, West German OLS patent NOS. 2,414,830 and 2,454,329, Japanese Patent O.P.I. Publication Nos. 59838/1973, 26034/1976, 5055/1973, 146828/1976, 69624/1977 and 90932/1977.

In the silver halide emulsion to be used in the light-sensitive silver halide photographic material of this invention (hereinafter referred to as the silver halide emulsion of this invention). as the silver halide thereof any arbitrary one for use in preparing ordinary silver halide emulsions, such as silver bromide, silver iodobromide, silver iodochloride, silver chlorobromide, silver chloride and the like.

The silver halide emulsion of this invention may be chemically sensitized by any of the sulfur sensitization method, selenium sensitization method, reduction sensitization method, noble-metal sensitization method, and the like.

The silver halide emulsion of this invention may be optically sensitized to desired wavelength regions by using those dyes known as sensitizing dyes to those skilled in the art in the photographic field.

The light-sensitive silver halide photographic material of this invention may use arbitrarily anti-color-stain agent. hardening agent, plasticizer, polymer latex, ultraviolet agent, formalin scavenger, mordant, development accelerator, development retarder, brightening agent, matting agent, lubricant, antistatic agent, surface active agent, and the like.

The light-sensitive silver halide photographic material containing the yellow coupler of this invention, by incorporating an ultraviolet absorbing agent thereinto, can be improved on the durability of a yellow dye image formed therefrom.

The light-sensitive silver halide photographic material may be processed in arbitrary procedure steps that are used commonly by those skilled in the art, such as, for example, the steps comprising color developing, bleaching and fixing or bleach-fix, stabilizing, washing, stopping and the like.

As has been described, the light-sensitive silver halide photographic material of this invention, since it comprises both the magenta coupler and the yellow coupler of this invention, is capable of forming magenta and yellow dyes improved on the spectral absorption characteristic with the image preservability and color formability thereof retained enough for practical use, thus having a largely improved color reproducibility for all colors.

EXAMPLES

The present invention will be illustrated further in detail by the following examples, but the embodiment of this invention is not limited by the examples.

EXAMPLE-1

(Preparation of Silver Halide Emulsions)

Three different silver halide emulsions were prepared as given in Table i by the neutral process and the simultaneously mixing method.

TABLE 1

| Emulsion No. | AgCl % | AgBr % | Average grain size μ | Chemical sensitizer | Spectral sensitizer |
|---|---|---|---|---|---|
| Em-1 | 99.5 | 0.5 | 0.67 | Sodium*1 thiosulfate | SD-1*3 |
| Em-2 | 99.5 | 0.5 | 0.46 | Sodium*1 thiosulfate | SD-2*4 |
| Em-3 | 99.5 | 0.5 | 0.43 | Chloro-*2 | SD-3*5 |

TABLE 1-continued

| Emulsion No. | AgCl % | AgBr % | Average grain size μ | Chemical sensitizer | Spectral sensitizer |
|---|---|---|---|---|---|
| | | | | auric acid | |

*[1]2 mg per mole of silver halide were added
*[2]5 × $10^{-5}$ mole per mole of silver halide was added.
*[3]0.9 millimole per mole of silver halide was added.
*[4]0.7 millimole per mole of silver halide was added.
*[5]0.2 millimole per mole of silver halide was added.

To each of the silver halide emulsions, after being chemically sensitized, was added $5\times10^{-3}$ mole per mole of silver halide of the following emulsion sensitizer STB-1.

[SD-1]

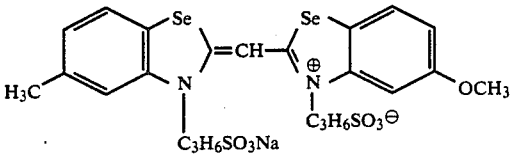

[SD-2]

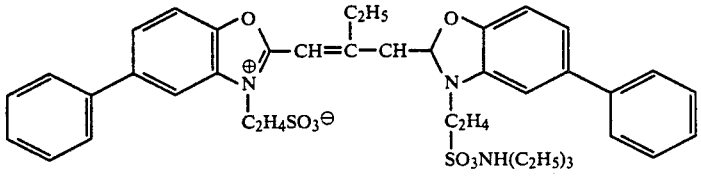

[SD-3]

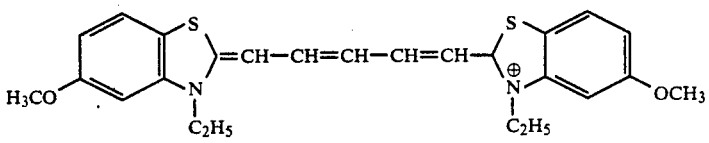

[STB-1]

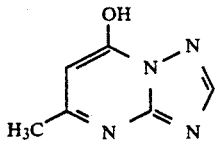

(Preparation of Light-Sensitive Silver Halide Color Photographic Material Samples)

Subsequently, the following layers 1 through 7 were simultaneously coated in the described order on a both-side-polyethylene-laminated paper support, whereby light-sensitive silver halide color photographic material samples Nos. 1 through 15 were prepared. (In the following examples, every adding amount is indicated in an amount per m, of the light-sensitive material.)

Layer 1 . . . A layer containing 1.2 g of gelatin, 0.29 g (silver equivalent) of the blue-sensitive silver halide emulsion (Em-1) and 0.3 g of dinonyl phthalate (DNP) into which are dissolved 1.0 millimole of the yellow coupler given in Table-2, 0.3 g of a stabilizer ST-1 and 0.015 g of 2,5-dioctylhydroquinone (HQ-1).

Layer 2 . . . A layer containing 0.9 g of gelatin and 0.2 g of DOP (dioctyl phthalate) into which is dissolved 0.04 g of HO-1.

Layer 3 . . . A layer containing 1.4 g of gelatin, 0.2 g of the green-sensitive silver halide emulsion (Em-2), 0.3 g of DOP into which are dissolved 0.9 millimole of the magenta coupler given in Table-2, 0.25 g of a stabilizer ST-2, 0.3 g of ST-3 and 0.01 g of HQ-1, and 6 mg of the following filter dye AI-1.

Layer 4 . . . A layer containing 1.2 g of gelatin and 0.3 g of DNP into which are dissolved 0.6 g of the following ultraviolet absorbing agent UV-1 and 0.05 g of HQ-1.

Layer 5 . . . A layer containing 1.4 g of gelatin, 0.20 g of the red-sensitive silver halide emulsion (Em-3) and 0.3 g of DOP into which are dissolved 0.54 g of a cyan coupler (C-1). 0.01 g Of HQ-1 and 0.3 g of ST-1.

Layer 6 . . . A layer containing 1.1 g of gelatin, 0.2 g of DOP into which is dissolved 0.2 g of UV-1, and 5 mg of the following filter dye AI-2.

Layer 7 . . . A layer containing 1.0 g of gelatin and 0.05 g of sodium 2,4-dichloro-6-hydroxytriazine.

C-1

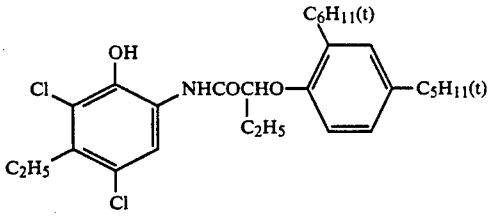

ST-1

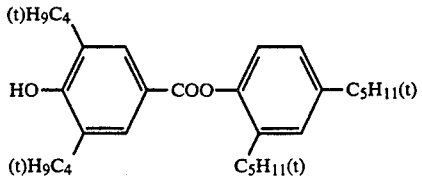

ST-2

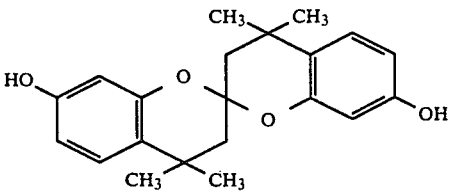

-continued

ST-3

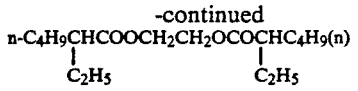

UV-1

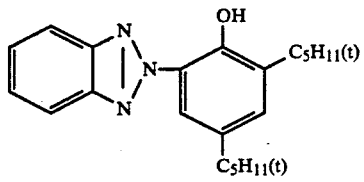

AI-1

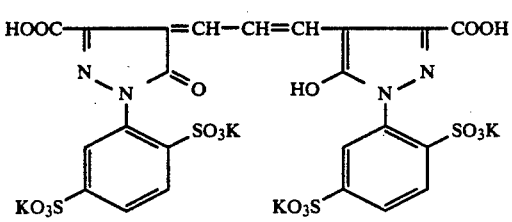

AI-2

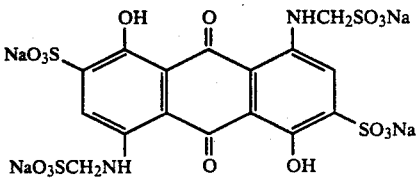

Each of the obtained samples was exposed through an optical wedge to separate monochromatic blue, green and red lights by using a sensitometer KS-7 (manufactured by Konishiroku Photo Industry Co., Ltd.). and then processed in accordance with the following color developing procedure. and after that, each of the processed samples was measured with respect to the maximum densities (Dmax) of the green-sensitive emulsion layer and blue-sensitive emulsion layer thereof by using an optical densitometer PDA-65 (manufactured by Konishiroku Photo Industry Co.. Ltd.).

Also, the obtained samples each was subjected to a 15-day discoloration test in a fade-o-meter, and the residual rate (%) of the dye image at the initial density of 1.0 was found with respect to each of the blue-sensitive emulsion layer and green-sensitive emulsion layer to thereby evaluate the resistance to light thereof.

In addition, a Color Checker (manufactured by Macbeth Co.) was photographed with use of Sakuracolor SRV-100 film (manufactured by Konishiroku Photo Industry Co.. Ltd.), and the film was processed, and the thus obtained negative, after adjusting the tone of its image portion corresponding to the grey area, was used to print its image on each of the aboveobtained samples to thereby evaluate the color reproducibility for the respective colors.

The obtained results are shown in Table-2.

| Processing Steps | Temperature | Time |
|---|---|---|
| Color developing | 34.7 ± 0.3° C. | 45 seconds |
| Bleach-fix | 34.7 ± 0.5° C. | 50 seconds |
| Stabilizing | 30 to 34° C. | 90 seconds |
| Drying | 60 to 80° C. | 60 seconds |

Color Developer Solution

Pure water: 800 ml
Triethanolamine: 8 g
N,N-di-ethylhydroxyamine: 5 g
Potassium chloride: 2 g
N-ethyl-N-$\frac{7}{8}$-methansulfonamidoethyl-3-methyl-4-aminoaniline sulfate: 5 g
Sodium tetrapolyphosphate: 2 g
Potassium carbonate: 30 g
Potassium sulfite: 0.2 g
Brightening agent (4,4'-diaminostilbenedisulfonic acid derivative): 1 g
Pure water to make 1 liter. Adjust the pH to 10.2.

Bleach-Fix Bath

Ferric-ammonium ethylenediaminetetraacetate dihydrated: 60 g
Ethylenediaminetetraacetic acid: 3 g
Ammonium thiosulfate (aqueous 70% solution): 100 ml
Ammonium sulfite (aqueous 40% solution): 27.5 ml
Use potassium carbonate or glacial acetic acid to adjust the pH to 5.7, and add water to make 1 liter.

Stabilizer Bath

5-Chloro-2-methyl-4-isothiazolin-3-one: 1 g
1-Hydroxyethyliden-1,1-diphosphonic acid: 2 g
Water to make 1 liter. Use sulfuric acid or potassium hydroxide to adjust the pH to 7.0.

TABLE 2

| Sample No. | Yellow coupler | Magenta coupler | Maximum density Y*6 | Maximum density M*7 | Resistence to light Y*6 | Resistence to light M*7 | Color reproducibility*8 Blue | Green | red | Yellow | Magenta | Cyan | Yellow-green | Remarks |
|---|---|---|---|---|---|---|---|---|---|---|---|---|---|---|
| 1 | YY-1 | MM-1 | 2.13 | 2.61 | 84 | 79 | B | C | B | B | B | A | B | Comparative |
| 2 | YY-1 | 23 | 2.15 | 2.72 | 83 | 81 | A | B | A | B | A | A | B | Comparative |
| 3 | 3 | MM-1 | 2.55 | 2.60 | 86 | 78 | B | A | B | A | B | A | A | Comparative |
| 4 | 3 | 23 | 2.58 | 2.75 | 88 | 82 | A | A | A | A | A | A | A | Invention |
| 5 | 3 | 10 | 2.56 | 2.78 | 89 | 80 | A | A | A | A | A | A | A | Invention |
| 6 | 3 | 12 | 2.55 | 2.76 | 88 | 80 | A | A | A | A | A | A | A | Invention |
| 7 | 3 | 46 | 2.59 | 2.77 | 90 | 79 | A | A | A | A | A | A | A | Invention |
| 8 | 12 | 10 | 2.48 | 2.69 | 88 | 81 | A | A | A | A | A | A | A | Invention |
| 9 | 12 | 23 | 2.45 | 2.72 | 88 | 83 | A | A | A | A | A | A | A | Invention |
| 10 | 19 | 12 | 2.47 | 2.47 | 91 | 81 | A | A | A | A | A | A | A | Invention |
| 11 | 19 | 46 | 2.49 | 2.76 | 90 | 80 | A | A | A | A | A | A | A | Invention |
| 12 | 32 | 23 | 2.52 | 2.71 | 89 | 84 | A | A | A | A | A | A | A | Invention |
| 13 | 32 | 63 | 2.54 | 2.70 | 88 | 83 | A | A | A | A | A | A | A | Invention |
| 14 | 46 | 23 | 2.51 | 2.76 | 88 | 85 | A | A | A | A | A | A | A | Invention |

TABLE 2-continued

| Sample No. | Yellow coupler | Magenta coupler | Maximum density Y*6 | Maximum density M*7 | Resistence to light Y*6 | Resistence to light M*7 | Color reproducibility*8 Blue | Green | red | Yellow | Magenta | Cyan | Yellow-green | Remarks |
|---|---|---|---|---|---|---|---|---|---|---|---|---|---|---|
| 15 | 46 | 63 | 2.50 | 2.79 | 90 | 84 | A | A | A | A | A | A | A | Invention |

Note:
*6Blue-sensitive emulsion layer
*7Green-sensitive emulsion layer
*8A: Color reproducibility (hue, chroma) excellent
B: Color reproducibility (hue, chroma) somewhat poor
C: Color reproducibility (hue, chroma) inferior Comparative Yellow Coupler (YY-1)

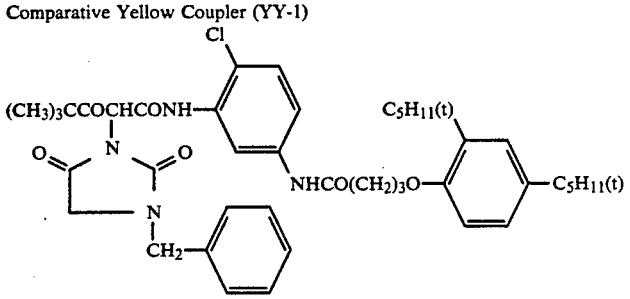

Comparative Magenta Coupler (MM-1)

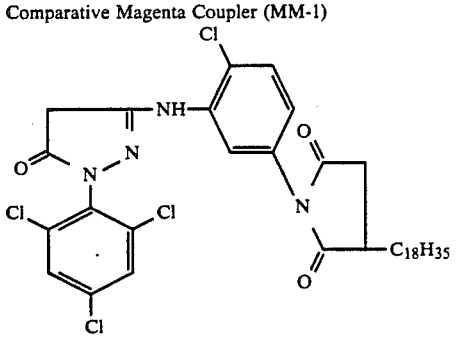

As is apparent from the results shown in Table-2, in comparison with Sample No. 1, in which the non-invention yellow coupler and magenta coupler are used, Sample No. 2, in which the magenta coupler alone is replaced by the pyrazole-type coupler of this invention, is recognized to have been improved on the color reproducibility for the respective blue, green, red and magenta colors, while Sample No. 3, in which the yellow coupler alone is replaced by the yellow coupler of this invention, is recognized to have been improved on the color reproducibility for the respective green, yellow and yellow-green colors. However. any of the above samples are not considered to have adequate colors from the stand point of color reproducibility, so that they cannot be regarded as photographic light-sensitive materials collectively excellent in the color reproducibility.

In contrast, Samples Nos. 4 through 15, in which the magenta coupler and yellow coupler used are all of this invention, are excellent in the color reproducibility for all colors, so that they prove the effect of this invention to be excellent.

Further, as is apparent from Table 2, Samples Nos. 4 through 15, in which both the magenta coupler of this invention and the yellow coupler of this invention are combinedly used, have sufficiently high maximum densities as compared with those of Samples No. 1 through 3, in which the noninvention magenta coupler and/or the non-invention yellow coupler are used, and in addition, in the resistance to light. the former samples are equal to or better than the latter samples.

What is claimed is:

1. A silver halide light-sensitive photographic material having a support, provided thereon, a blue-sensitive layer, a green-sensitive layer and a red-sensitive layer, wherein said blue-sensitive layer comprises a yellow coupler having Formula Y-I and said green-sensitive layer comprises a magenta coupler having Formula M-I,

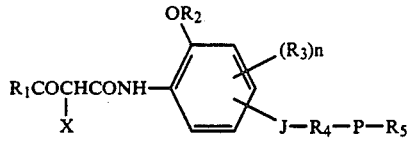

Y-I wherein $R_1$ is selected from the group consisting of an alkyl group and a cycloalkyl group; $R_2$ is selected from the group consisting of an alkyl group, a cycloalkyl group, an acyl group and an aryl group; $R_3$ represents a group substitutable to a benzene ring; n represents an integer of 0 or 1; J is selected from the group consisting of

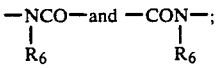

$R_6$ is selected from the group consisting of a hydrogen atom, an alkyl group, an aryl group and a heterocyclic group; $R_4$ represents an unsubstituted alkylene group that may be unbranched or branched; P represents $$-COO-,\ -\underset{\underset{R'}{|}}{N}CO-,\ -CO\underset{\underset{R'}{|}}{N}-,\ -\underset{\underset{R'}{|}}{N}CO\underset{\underset{R''}{|}}{N}-,\ -\underset{\underset{R'}{|}}{N}COO-,$$

$$SO_2,\ \underset{\underset{R'}{|}}{N}SO_2-,\ -SO_2\underset{\underset{R'}{|}}{N}-,\ \text{or}\ -\underset{\underset{R'}{|}}{N}SO_2\underset{\underset{R''}{|}}{N}-$$

and R′ and R″ independently are selected from the group consisting of a hydrogen atom, an alkyl group, an aryl group and a heterocyclic group; $R_5$ is selected from the group consisting of an alkyl group, a cycloalkyl group, an aryl group and a heterocyclic group; and X represents a group capable of splitting off by reaction with an oxidation product of a color developing product,

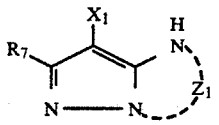

wherein $Z_1$ represents a group of non-metal atoms necessary to form a heterocyclic ring together with —NH—, the ring formed by $Z_1$ may have a substituent; $X_1$ represents a group capable of splitting off by reaction with an oxidation product of a color developing agent; and $R_7$ is selected from the group consisting of a hydrogen atom and a substituent.

2. The material of claim 1, wherein said $R_3$ represents a halogen atom, an alkyl group, an alkoxy group, an aryloxy group, an acyloxy group, an acylamino group, a carbamoyl group, an alkylsulfonamide group, an arylsulfonamide group, a sulfamoyl group, or a imide group.

3. The material of claim 1, wherein said R′ and R″ each represents a hydrogen atom.

4. The material of claim 1, wherein said X represents a group having one of Formulas Y-II to Y-VIII,

Y-II

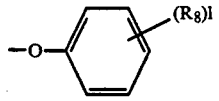

wherein l is an integer of 1 to 5; $R_8$ represents one of the groups represented by $R_3$, provided that $R_8$ may be same or different when l is 2 or more,

Y-III

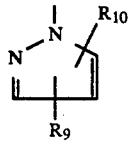

Y-IV

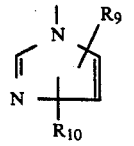

-continued

Y-V

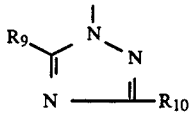

wherein $R_9$ and $R_{10}$ represent independently a hydrogen atom, a halogen atom, an alkyl group, an alkoxy group, an aryl group, a heterocyclic group, a carboxylic ester group, an amino group, an acylamino group, an alkylsulfonyl group, an arylsulfonyl group, an alkylsulfinyl group, an arylsulfinyl group, an alkylsulfonamide group, an arylsulfonamide group, and a carboxylic acid group, provided that $R_9$ and $R_{10}$ may form a ring,

Y-VI

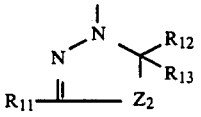

Y-VII

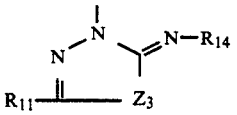

wherein $Z_2$ and $Z_3$ represent independently a hetero-atom; $R_{11}$, $R_{12}$ and $R_{13}$ represent independently the same groups as those represented by $R_9$ and $R_{10}$; $R_{14}$ represents an alkyl group, an aryl group, an alkylcarbonyl group, an arylcarbonyl group, an alkysulfonyl group, or an arylsulfonyl group,

Y-VIII

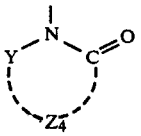

wherein Y represents a hetero-atom, a group of hetero-atoms, a sulfonyl group, a carbonyl group,

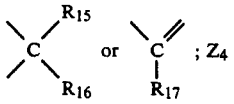

represents a group of non-metal atoms necessary to form a 5 or 6-membered ring together with Y, —N— and —CO—; $R_{15}$; $R_{16}$ and $R_{17}$ represent independently the same groups as those represented by $R_9$ and $R_{10}$, provided that $R_{15}$, $R_{16}$, and $R_{17}$ may form a ring with a part of $Z_4$.

5. The material of claim 1, wherein said substituent represented by $R_7$ is an alkyl group, an aryl group, an anilino group, an acylamino group, an alkylthio group, an arylthio group, an alkenyl group, a cycloalkyl group, a cycloalkenyl group, an alkinyl group, a heterocyclic group, an alkoxy group, an aryloxy group, a heterocyclic oxy group, an ureido group, an alkoxycarbonylamino group, an aryloxycarbonylamino group, a spiro compound residue, or a cross-linked hydrocarbon residue.

6. The material of claim 5, wherein $X_1$ represents a hydrogen atom, a halogen atom, an alkoxy group, an aryloxy group, a heterocyclic oxy group, an alkylthio group, an arylthio group, a heterocyclic thio group, an acylamino group, a sulfonamide group, a nitrogen-containing heterocyclic group whose ring is formed by the bonding of an N group, or a carboxyl group.

7. The material of claim 5, wherein said magenta coupler is represented by one of Formulas M-III to M-VI;

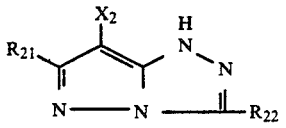

M-III

-continued

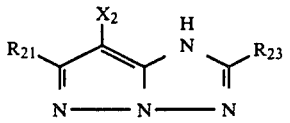

M-IV

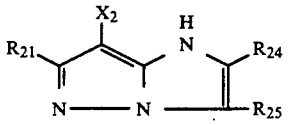

M-V

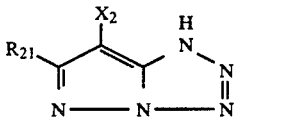

M-VI wherein $R_{21}$ to $R_{25}$ represent the same groups as those represented by $R_7$; $X_2$ represents the same groups as those represented by $X_1$.

8. The material of claim 4, wherein $R_8$ represents a carboxyl group, an ester group, an acyl group, an alkylsulfonyl group, an arylsulfonyl group, or a hydroxy group.

* * * * *

UNITED STATES PATENT AND TRADEMARK OFFICE

CERTIFICATE OF CORRECTION

PATENT NO. : 5,023,169

DATED : June 11, 1991

INVENTOR(S) : Shigeto Hirabayashi et al.

It is certified that error appears in the above-identified patent and that said Letters Patent is hereby corrected as shown below:

Claim 1, column 57, line 25, insert figure label, i.e., --M-I--.

Claim 2, column 57, line 39, after "or" change "a" to --an--.

Claim 4, column 58, line 55, after "$R_{15}$" change ";" to --,--.

Signed and Sealed this

Twenty-seventh Day of April, 1993

*Attest:*

MICHAEL K. KIRK

*Attesting Officer*

*Acting Commissioner of Patents and Trademarks*